United States Patent [19]

Fava et al.

[11] Patent Number: 4,636,369

[45] Date of Patent: Jan. 13, 1987

[54] ESSENTIALLY COMPLETE RECOVERY OF URANIUM, YTTRIUM, THORIUM AND RARE EARTH VALUES FROM PHOSPHATE ROCK DURING WET-PROCESS PRODUCTION OF PHOSPHORIC ACID THEREFROM

[75] Inventors: Jean Fava, Pessac; André Lambert, Puiseux; Jean-Paul Tognet, La Rochelle, all of France

[73] Assignee: Rhone-Poulenc Chimie de Base, Courbevoie, France

[21] Appl. No.: 550,627

[22] Filed: Nov. 10, 1983

[30] Foreign Application Priority Data

Nov. 10, 1982 [FR] France ..... 82 18910

[51] Int. Cl.[4] ..... C01G 43/00

[52] U.S. Cl. ..... 423/20; 423/10; 423/18; 423/21.1

[58] Field of Search ..... 423/10, 18, 20, 21.1

[56] References Cited

U.S. PATENT DOCUMENTS

| | | | |
|---|---|---|---|
| 2,425,573 | 8/1947 | Soddy | 423/18 |
| 2,743,156 | 8/1956 | Metziger et al. | 423/18 |
| 2,761,758 | 9/1956 | Long et al. | 23/14.5 |
| 2,789,879 | 4/1957 | Kaufman | 23/14.5 |
| 2,819,145 | 1/1958 | McCullough et al. | 423/18 |
| 2,841,467 | 7/1958 | McCullough | 423/18 |
| 2,859,092 | 11/1958 | Bailes et al. | 423/18 |
| 2,990,244 | 6/1961 | Brown et al. | 423/18 |
| 3,937,783 | 2/1976 | Wamser et al. | 423/8 |
| 4,108,957 | 8/1978 | Michel | 423/18 |
| 4,282,188 | 8/1981 | Demarthe et al. | 423/10 |
| 4,284,614 | 8/1981 | Oré | 423/10 |
| 4,374,805 | 2/1983 | Worthington et al. | 423/10 |
| 4,461,748 | 7/1984 | Sabot et al. | 423/10 |

OTHER PUBLICATIONS

Greek et al, *Ind. & Eng. Chem.*, 49 (#4), pp. 628, 9 & 31, (Apr. 1957).

Chemical Abstracts, vol. 92, No. 16, Apr. 1980, p. 240, No. 132691k, Columbus, Ohio.

*Primary Examiner*—Edward A. Miller

*Attorney, Agent, or Firm*—Burns, Doane, Swecker & Mathis

[57] ABSTRACT

The uranium, yttrium, thorium and rare earth values contained in a phosphate rock are essentially totally recovered therefrom by, during the wet-process preparation of phosphoric acid from said phosphate rock, acidulating same in the presence of aluminum and/or iron, and optionally silica, and thence recovering said values from the phosphoric acid thus produced.

11 Claims, No Drawings

ESSENTIALLY COMPLETE RECOVERY OF URANIUM, YTTRIUM, THORIUM AND RARE EARTH VALUES FROM PHOSPHATE ROCK DURING WET-PROCESS PRODUCTION OF PHOSPHORIC ACID THEREFROM

BACKGROUND OF THE INVENTION

1. Field of the Invention

The present invention relates to the total recovery of uranium, yttrium, thorium and rare earth values contained in a phosphate-bearing ore over the course of the wet-process preparation of phosphoric acid.

2. Description of the Prior Art

It is known to this art that the phosphate-bearing ores used for the production of phosphoric acid contain not inconsiderable amounts of uranium, yttrium, thorium and the rare earths. With respect to such ores, in the group comprising thorium, rare earths and yttrium, the yttrium values constitute an amount which is approximately one-half of the total amount of such values.

It too is known that, when subjecting a phosphate ore to attack by means of sulfuric acid, the major fraction of the uranium (approximately 95%) is solubilized in the phosphoric acid formed and well-known processes are used for recovering that element, in particular by liquid/liquid extraction, or by precipitation from the phosphoric acid of a secondary uranium-containing gypsum.

However, the major portion of the rare earths and yttrium present in the ore is not solubilized in the attack or acidulation operation, and coprecipitates with the gypsum. The amount of such elements which goes into solution depends upon the nature of the ore and generally ranges from about 5 to 20% of the total amount present in the ore. In order to subsequently recover such elements, the gypsum has to be treated, for example, by washing with sulfuric acid.

The recovery of the uranium values on the one hand and the other elements referred to above, on the other hand, therefore requires two separate treatments, one relating to the phosphoric acid and the other to the gypsum.

Serious need therefore exists in this art for a process which, in a single operation, provides for the combined recovery of all of the uranium values and the aforenoted other elements.

That problem has been partially solved. Indeed, a process is known (British Patent Specification No. 793,801) in which the degree of solubilization of the yttrium and rare earth values is increased, at the moment of the attack phase, by the addition of silica. This provides a solution of phosphoric acid which contains uranium and a portion of the yttrium and rare earths, which is larger than that achieved under the usual attack phase conditions.

However, the addition of silica concomitantly gives rise to a number of disadvantages.

First of all, if the proportion of rare earths and yttrium which is solubilized in the attack operation increases with the amount of silica added, a plateau is nonetheless quickly reached. Thus, it has been found difficult to solubilize more than approximately 40% of the total amount of the elements in question, in the attack operation.

Moreover, the addition of silica interferes with filtration of the attack slurry when separating the gypsum and the phosphoric acid. The greater the amount of silica, the greater the reduction in the rate of filtration. That is a very serious disadvantage from an industrial point of view.

Finally, the silica may be found to give rise to difficulties in the subsequent stages in a process for the production of phosphoric acid, in particular in liquid/-liquid extraction operations.

SUMMARY OF THE INVENTION

Accordingly, a major object of the present invention is the provision of an improved process for the solubilization of rare earth and yttrium values during the acidulation of phosphate rock without detrimentally affecting the subsequent performance of the process for the production of phosphoric acid.

Briefly, the process according to the invention features the total recovery of uranium, yttrium, thorium and rare earth valves contained in a phosphate-bearing ore over the course of the wet-process for the preparation of phosphoric acid and is characterized in that, during the acidulation of the phosphate rock, aluminum and/or iron is introduced into the attack medium.

DETAILED DESCRIPTION OF THE INVENTION

More particularly according to the present invention, the subject process makes it possible to achieve percentages in respect of solubilization of the aforenoted values, which are typically higher than those in respect of silica, while maintaining a shorter filtration time.

Other features of the invention will be more clearly apparent from the following description and the specific examples for carrying out the subject process.

The operation of attacking the phosphate-bearing ore, which may be more advantageously carried out with sulfuric acid, is conducted under the usual, known conditions in respect of temperature and concentration of acids.

The aluminum or iron may be introduced either together with the attack acid or added into the attack slurry. They may also be premixed with the phosphate ore.

The aluminum is advantageously added in the form of a salt of that element, for example, in the form of a sulfate, a phosphate, an alumina or any other precursor which is capable of liberating the aluminum ion in situ under the conditions of attack. The same also applies with respect to the iron which is advantageously added in the form of its sulfate or oxide such as ferric oxide.

It is also possible to use alumino-calcium phosphates containing iron such as the Thies phosphates and the Taiba fines. Such phosphates simultaneously provide both aluminum and iron.

It has also been found that it is possible to use a mixture of silica and aluminum. Such provides a percentage in respect of solubilization of yttrium and rare earths, which is higher than that achieved by the addition of silica alone, with a filtration time which remains acceptable. In this case, it is suggested to use a natural silica of the kieselguhr type, a globular silica or a precipitated silica. The aluminum may be used in the forms described hereinbefore.

Finally, it is also possible to use a mixture of silica and iron or silica, iron and aluminum.

The amounts of aluminum, iron and silica used depend upon the type of ore being treated, the attack conditions which are to be used and the type of acid which is to be produced. By way of example, in regard to aluminum, it is advantageous to use an amount which varies from about 0.8 to 1.5% by weight expressed in respect of $Al_2O_3$ with respect to the ore.

Also by way of example, the iron may be present in an amount which is within the above-defined range, the iron content being expressed in respect of $Fe_2O_3$.

After the attack operation, the resulting slurry is filtered. Such provides a residue or primary gypsum in the case of a sulfuric attack operation and a solution of phosphoric acid. In this context, the term gypsum is used to denote all of the solid produced after the filtration operation. The solution of phosphoric acid contains in particular almost all of the uranium present in the initial ore and a substantial proportion of the yttrium, thorium and rare earth values.

The process for the recovery of all such elements may be carried out in the manner described in published European Patent Application No. 26,132. In that case, the acid is contacted with an organic phase containing a di(alkylphenyl)phosphoric acid, which is dissolved in an inert organic solvent, and in the presence of a trialkylphosphine oxide. After phase separation, the organic phase is re-extracted by means of a solution containing hydrofluoric acid and phosphoric acid.

In order to further illustrate the present invention and the advantages thereof, the following specific examples are given, it being understood that same are intended only as illustrative and in nowise limitative.

EXAMPLE 1

The starting material was a Kouribga phosphate ore of the following composition: 31.07% of $P_2O_5$; 344 ppm of yttrium and 140 ppm of uranium; $CeO_2$: 42 ppm; $La_2O_3$: 132 ppm; $Tb_4O_7$: 9 ppm; $Yb_2O_3$: 21 ppm.

The ore was subjected to attack by means of sulfuric acid without any additive, then, in a second series of tests, in the presence of a variable amount of precipitated silica and, in a third series of tests, in the presence of aluminum sulfate and a variable amount of a mixture of aluminum sulfate and silica.

Table 1 reports the results obtained in the case of yttrium while Table 2 reports the percentages of solubilization in respect of different elements.

The amount of aluminum is calculated in terms of $Al_2O_3$.

It will be noted that, for these examples and the following example, the filtration times given were obtained by measuring the time for filtering the attack slurry on a Buchner funnel and the time for filtration of the cake after the addition of an amount of washing water which was representative of the amount of washing water used under industrial conditions of operation. The sum of those two periods of time for each test corresponded to the time specified in Table 1.

It was found that the process according to the invention provided for a marked increase in the recovered percentage of rare earths and yttrium and in particular yttric elements such as Tb and Yb.

Moreover, at the same time as that increase in recovery, the filtration times attained were much better than when using silica. This is a particularly important advantage on an industrial scale, since the level of attack productivity depends upon the filtration time.

EXAMPLE 2

The same ore as used in the previous example was subjected to attack, but this time, in the presence of ferric sulfate.

With an amount of iron calculated in terms of $Fe_2O_3$ of 0.8% by weight with respect to the ore, 40% of the amount of $Y_2O_3$ present in the ore was solubilized and the filtration time was 109 sec.

TABLE 1

| Additive | Amount in % by weight with respect to the ore | Percentage of $Y_2O_3$ solubilized relative to the total amount contained in the ore | Attack slurry filtration time, in seconds |
|---|---|---|---|
| Without additive | 0 | 18 | 60 |
| Silica | 0.5 | 32 | 85 |
| | 1 | 36 | 157 |
| | 3 | 37 | 254 |
| | 6 | 41 | 337 |
| Aluminum | 0.8 | 50 | 80 |
| | 1.5 | 56 | 104 |
| Aluminum + Silica | 0.8 | 46 | 183 |
| | 1 | | |

TABLE 2

Degree of solubilization of various elements
Percentage solubilized with respect to the total amount contained in the ore

| Additive Elements | Without additive | 6% of silica | 1.5% of aluminum |
|---|---|---|---|
| $Y_2O_3$ | 18 | 41 | 56 |
| $CeO_2$ | ε | 5 | 53 |
| $La_2O_3$ | 20 | 14 | 32 |
| $Tb_4O_7$ | 51 | 54 | 73 |
| $Yb_2O_3$ | 45 | 60 | 67 |
| $U_3O_8$ | 96 | 97 | 96 |

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. A process for the improved recovery of uranium, yttrium, thorium and rare earth values contained in a phosphate rock having a relatively low aluminum and iron content, during the wet-process preparation of phosphoric acid therefrom, comprising the step of acidulating said phosphate rock and adding a predetermined amount of aluminum ion, iron ion or a combination thereof sufficient to result in an amount of aluminum, expressed as $Al_2O_3$, and/or amount of iron, expressed as $Fe_2O_3$, of about 0.8 percent to 1.5 percent by weight with respect to the amount of phosphate rock acidulated, said predetermined amount added being sufficient to improve the recovery of said uranium, yttrium, thorium and rare earth values from the phosphate rock in the phosphoric acid solution thus produced.

2. The process as defined by claim 1, an aluminum salt comprising the source of added aluminum ion.

3. The process as defined by claim 2, said aluminum salt comprising aluminum sulfate, aluminum phosphate or alumina.

4. The process as defined by claim 1, an iron salt comprising the source of added iron ion.

5. The process as defined by claim 4, said iron salt comprising iron sulfate or iron oxide.

6. The process as defined by claim 1, an iron-containing alumino-calcium phosphate comprising the source of both aluminum and iron ions.

7. The process as defined by claim 1, said adding step further comprising adding a predetermined amount of silica.

8. The process as defined by claim 1, said acidulation being carried out with sulfuric acid.

9. The process as defined by claim 1, said adding step further comprising adding a predetermined amount of iron ion and silica.

10. A process for the improved recovery of uranium, yttrium, thorium and rare earth metal values contained in phosphate rock which is relatively low in iron and aluminum during the wet-process preparation of phosphoric acid therefrom, comprising the step of acidulating said phosphate rock and adding a predetermined amount of at least one of aluminum or iron as salts, which is effective to provide an amount of aluminum, expressed as $Al_2O_3$, and/or an amount of iron, expressed as $Fe_2O_3$, which comprises from about 0.8 percent to about 1.5 percent by weight with respect to the amount of phosphate rock acidulated, thereby improving the recovery of said uranium, yttrium, thorium and rare earth values from the phosphate rock in the phosphoric acid solution thus produced.

11. The process as defined by claim 10, said adding step further comprising adding a predetermined amount of silica.

* * * * *